US005985792A

United States Patent [19]

Miyadera et al.

[11] Patent Number: 5,985,792

[45] Date of Patent: Nov. 16, 1999

[54] APPARATUS FOR COATING FINE PARTICLES TO PRODUCE THERMAL TRANSFER IMAGE RECEIVING SHEET METHOD OF PRODUCING THERMAL TRANSFER IMAGE RECEIVING SHEET AND THERMAL TRANSFER IMAGE RECEIVING SHEET PRODUCED THEREBY

[75] Inventors: Toshiyuki Miyadera; Fumio Matsui; Takanori Mitsuhata; Yasuo Hosoda, all of Tsurugashima, Japan

[73] Assignee: Pioneer Electronic Corporation, Tokyo-to, Japan

[21] Appl. No.: 08/921,460

[22] Filed: Sep. 2, 1997

[30] Foreign Application Priority Data

Sep. 3, 1996 [JP] Japan ..... 8-233461

[51] Int. Cl.[6] ..... B41M 5/035; B41M 5/38

[52] U.S. Cl. ..... 503/227; 428/29; 428/195; 428/206; 428/207; 428/913; 428/914

[58] Field of Search ..... 8/471; 428/195, 428/206, 207, 331, 913, 914, 29; 503/227

[56] References Cited

U.S. PATENT DOCUMENTS 5,658,850 8/1997 Taniguchi et al. ..... 503/227

5,830,562 11/1998 Mitsuhata et al. ..... 428/206

*Primary Examiner*—Bruce H. Hess

*Attorney, Agent, or Firm*—Morgan, Lewis & Bockius LLP

[57] ABSTRACT

An apparatus for coating fine particles to produce a thermal transfer image receiving sheet having: a base material supply section 1 for supplying a paper base material; a coating storage section 21 for storing a coating including white fine particles; a development section 2 having a sleeve 22 for holding the coating supplied from the coating storage section 21, a blade 23 for controlling a thickness of the coating held by the sleeve 22, a charge drum 24 having a photosensitive material for absorbing the coating in a dispersed manner from the sleeve 22, and a dot latent image forming device 25 for forming a dispersed dot latent image on the charge drum 24 by irradiating a laser beam to the charge drum 24 to absorb the coating on the charge drum 24 in said dispersed manner on the basis of the dispersed dot latent image; a transfer section 3 for electrostatically transferring the coating absorbed by the charge drum 24 onto the paper base material in the dispersed manner; a fixing section 4 having a heat roller and a press roller, and for fixing the transferred coating on the paper base material; and an ejection section 5 for ejecting the paper base material on which the coating is fixed by the fixing section 4.

3 Claims, 3 Drawing Sheets

APPARATUS FOR COATING FINE PARTICLES TO PRODUCE THERMAL TRANSFER IMAGE RECEIVING SHEET METHOD OF PRODUCING THERMAL TRANSFER IMAGE RECEIVING SHEET AND THERMAL TRANSFER IMAGE RECEIVING SHEET PRODUCED THEREBY

BACKGROUND OF THE INVENTION

1. Field of the Invention

The present invention generally relates to an apparatus for coating fine particles to produce a thermal transfer image receiving sheet for use in a thermal transfer recording, a method of producing a thermal transfer image receiving sheet by using the apparatus, and a thermal transfer image receiving sheet produced thereby.

2. Description of the Related Art

In a so-called sublimation type thermal transfer recording, an image is formed on a thermal transfer image receiving material by using a thermal transfer recording medium. The thermal transfer recording medium is composed of a base film and an ink layer formed on the base film. For example, the base film of the thermal transfer recording medium is constructed by a polyethlene terephthalate (PET) film, and an ink layer of the thermal transfer recording medium is constructed by sublimation dye. On the other hand, the thermal transfer image receiving material is formed by a paper, plastic film, etc. More specifically, when a thermal energy supplied to the thermal transfer recording medium by a heating device such as a thermal head, the sublimation dye in the ink layer of the thermal transfer recording medium is diffused and transferred onto the thermal transfer image receiving material. The density gradient of the sublimation dye can be adjusted by a unit of a dot, so that various full color images can be formed on the thermal transfer image receiving material by the sublimation dye.

Here, it is required that the thermal transfer image receiving material has a character to keep the shape of image formed by the sublimation dye diffused and transferred thereon.

In this regard, in the sublimation type thermal transfer recording, an exclusive paper (image receiving sheet) is used. The image receiving sheet is composed of a base film and a dye receptor layer formed on the base film in advance. More specifically, the base film of the image receiving sheet is constructed by a plain paper, a synthetic paper, etc. Further, the dye receptor layer formed on the base film is constructed by resin having a dyeing property, such as vinyl chloride, vinyl acetate, polyester, etc. Namely, the solution of the aforementioned resin is coated on the base film, and the solution coated on the base film is dried. Thus, the continuous coat called the dye receptor layer is formed on the base film.

Further, in order to improve the quality of an image formed on the thermal transfer image receiving sheet, research on the thermal transfer image receiving sheet is doing. Thus, a thermal transfer image receiving sheet having a dye receptor layer constructed by at least two regions of micro phase separation resins, whose dyeing properties are different from each other, has produced. More specifically, when the dye receptor layer is produced, a resin is separated into two parts having the same components each other, and one part is sensitized and other part is untreated, and then, the two part are mixed. Then, this mixture solution is coated on the base film. On the other hand, the dye receptor layer is also produced another method mentioned below. Namely, one resin having a high dyeing property and another resin having a low dyeing property, which are not compatible each other, are mixed each other. Then, this mixture solution is coated on the base film.

However, in the aforementioned thermal transfer image receiving sheet having a dye receptor layer constructed by two regions of micro phase separation resins, the resins included in the dye receptor are amorphous. Therefore, it is difficult to control their size, arrangement or shape. Namely, in the aforementioned thermal transfer image receiving sheet having a dye receptor layer constructed by two regions of micro phase separation resins, the distribution of the resin having a high dyeing property and the resin having a low dyeing property cannot be controlled. Therefore, nonuniformity is formed in the direction of plane and depth, so that the quality of an image becomes ununiform. The size of each of the resin having a high dyeing property and the resin having a low dyeing property is fixed by the kind of resin used therein or the condition of the solution. Therefore, the size of the network in the network structure in the dye receptor layer cannot voluntarily controlled, so that there are much restriction when the dye receptor layer is designed, and thus, the design of the dye receptor layer is difficult. Further, the boundary between the resin having a high dyeing property and the resin having a low dyeing property is not clear. Therefore, the dyed portion has continuity in a macro angle, so that dye is bled at the edge of print, and thus, the edge of the print is indefinite.

Further, in the sublimation type thermal transfer recording, since an image is recorded by thermal diffusion, the boundary between a record part and a blank (not record) part is indefinite because of the concentration gradient between these parts.

On the other hand, in the thermal transfer recording using a melting type ink film, ink is not fixed on the dye receptor layer, so that an image cannot printed. Therefore, this kind of the thermal transfer image receiving sheet cannot used with the melting type ink film.

SUMMARY OF THE INVENTION

It is therefore an object of the present invention to provide a thermal transfer image receiving sheet on which a high quality image can be formed and in which the restriction of design can be reduced.

According to the present invention, the above mentioned object can be achieved by an apparatus for coating fine particles to produce a thermal transfer image receiving sheet having: a supply section for supplying a paper base material; a storage section for storing a coating including white fine particles; a development section having a sleeve for holding the coating supplied from the storage section, a blade for controlling a thickness of the coating held by the sleeve, a charge drum formed by a photosensitive material for absorbing the coating onto a surface of the charge drum from the sleeve in a dispersed manner, in which a plurality of dots of the coating are dispersed on the surface, and a dot latent image forming device for forming a dispersed dot latent image on the surface of the charge drum by irradiating a laser beam to the surface of the charge drum in order to put the coating onto the surface of the charge drum from sleeve in the dispersed manner on the basis of the dispersed dot latent image; a transfer section for electrostatically transferring the coating absorbed by the charge drum onto the paper base material; a fixing section having a heat roller and a press roller, and for fixing the transferred coating on the paper base material; and an ejection section for ejecting the paper base material on which the coating is fixed by the fixing section.

Thus, the paper base material, for example a plain paper, is supplied to the supply section and is sequentially supplied to the development section from the supply section. In the development section, the coating is supplied to the sleeve from the storage section, and further, the coating is moved to the charge drum. At this time, the dispersed dot latent image is formed on the surface of the charge drum. Therefore, the coating moved to the charge drum is adhered on the surface of the charge drum in the disperse manner on the basis of the dispersed dot latent image. In the transfer section, the coating adhered on the surface of the charge drum in the dispersed manner is electrostantically transferred to the paper base material. As a result, the coating is transferred to the paper base material in the dispersed manner. In the fixing section, the coating transferred to the paper base material in the dispersed manner is heated and pressed, and thus, the coating melts on the paper base material. As a result, the dispersed and discontinuous receptor layer coating membrane is formed on the paper base material. In the ejection section, the paper material on which the dispersed and discontinuous receptor layer coating membrane is formed is ejected.

In this manner, by supplying the paper base material on which the receptor layer is not formed, for example a plain paper, the thermal transfer image receiving sheet having the dispersed and discontinuous receptor layer coating membrane can be easily obtained. By this dispersed and discontinuous receptor layer coating membrane, bleeding of ink (dye), i.e., excessively spreading ink can be prevented.

Further, according to the present invention, the above mentioned object can be achieved by a method of producing a thermal transfer image receiving sheet by using an apparatus having: a supply section for supplying a paper base material; a storage section for storing a coating including white fine particles; a development section having a sleeve for holding the coating supplied from the storage section, a blade for controlling a thickness of the coating held by the sleeve, a charge drum formed by a photosensitive material for absorbing the coating onto a surface thereof from the sleeve in a dispersed manner, and a dot latent image forming device for forming a dispersed dot latent image on the surface of the charge drum by irradiating a laser beam to the surface of the charge drum in order to put the coating onto the surface of the charge drum from the sleeve in the dispersed manner on the basis of the dispersed dot latent image; a transfer section for electrostatically transferring the coating absorbed by the charge drum onto the paper base material; a fixing section having a heat roller and a press roller, and for fixing the transferred coating on the paper base material; and an ejection section for ejecting the paper base material on which the coating is fixed by the fixing section, the method having the processes of: supplying the paper base material by the supply section; storing the coating in the storage section; forming the dispersed dot latent image on the surface of the charge drum by irradiating the laser beam to the surface of the charge drum by the dot latent image forming device of the development section; absorbing the coating onto the surface of the charge drum in the dispersed manner on the basis of the dispersed dot latent image by the development section; transferring electrostatically the coating onto the paper base material so as to form a dispersed receptor layer coating membrane on the paper base material by the transfer section; fixing the transferred coating on the paper base material by the fixing section; and ejecting the paper base material on which the dispersed receptor layer coating membrane is formed by the ejecting section.

In this method, the thermal transfer image receiving sheet having the dispersed and discontinuous receptor layer coating membrane can be easily produced. Further, the number of the thermal transfer image receiving sheet is freely controlled as the occasion demand.

According to the present invention, the above mentioned object can be achieved by a thermal transfer image receiving sheet having: a base paper material; and a receptor layer coating membrane formed on the base paper material by coating including white fine particles with a coating in the dispersed manner.

Namely, since the receptor layer coating membrane is discontinuous, it can be prevented that ink excessively spread by thermal diffusion at the time of printing. Thus, bleeding of ink can be reduced, so that the clear image can be formed on the thermal transfer image receiving sheet. Further, since the receptor layer coating membrane is discontinuous, the exposure portion can be formed on the paper base material in the dispersed manner. Therefore, according to this thermal transfer image receiving sheet, the fixation property is obtained in the thermal transfer recording using the a melting type ink, so that the thermal transfer recording using the melting type ink can be carried out. Furthermore, this thermal transfer image receiving sheet can be easily produced by using the plain paper.

Further, the receptor layer coating membrane is formed by arranging a plurality of dots of the coating in the dispersed manner, and a diameter of each of dots of the coating is not more than half of a diameter of each of a plurality of print dots formed at the time of printing.

Thus, bleeding of ink can be effectively reduced, so that the definite image can be formed on the thermal transfer image receiving sheet.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, an embodiment of the present invention will be now explained.

Figure 1:
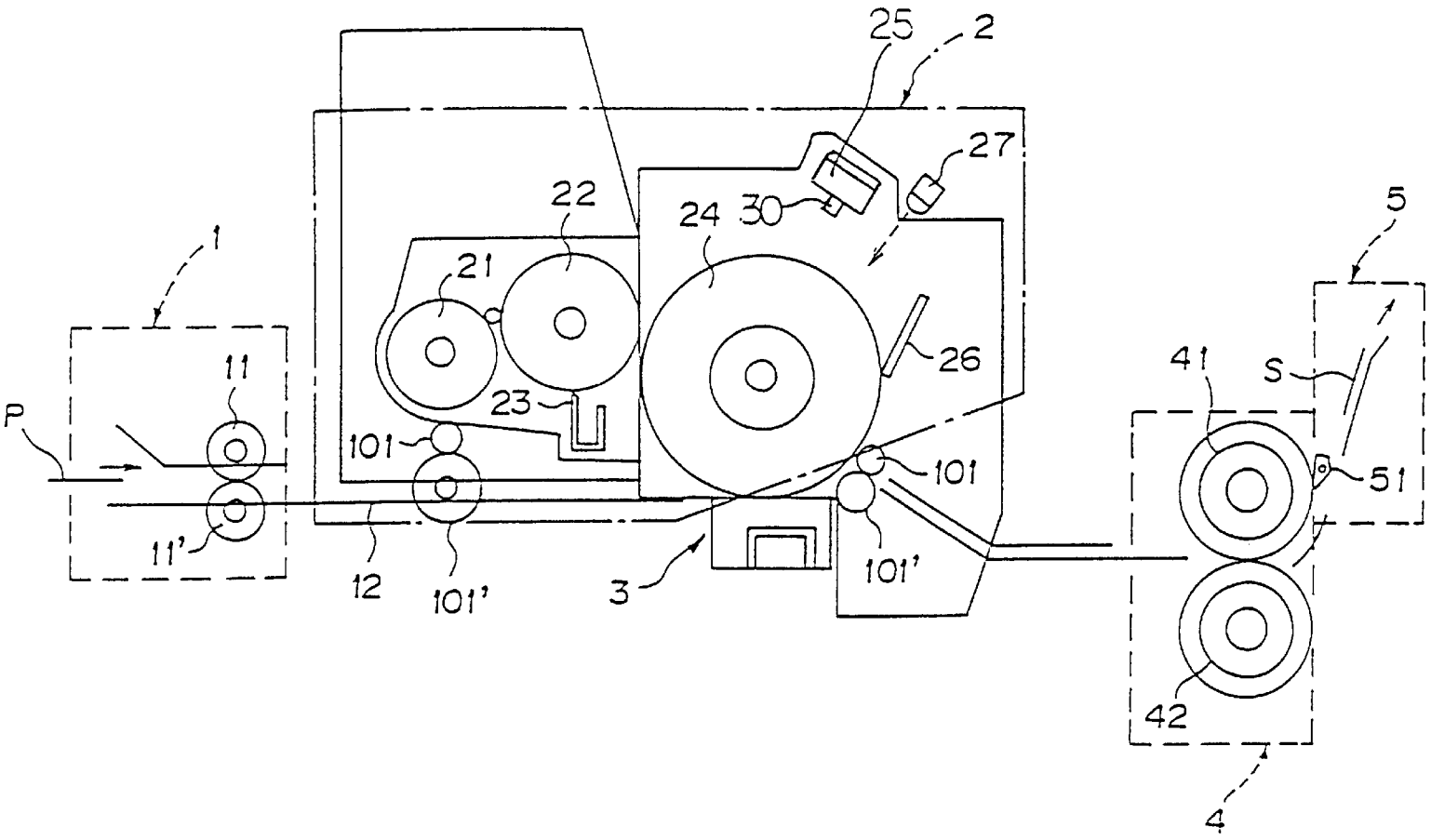
FIG. 1 is a diagram showing an apparatus for coating fine particles to produce a thermal transfer image receiving sheet according to an embodiment of the present invention.

FIG. 1 shows an apparatus 100 for coating fine particles to produce a thermal transfer image receiving sheet of the present invention. As shown in FIG. 1, the apparatus 100 is provided with a base material supply section 1, a development section 2, a transfer section 3, a fixing section 4, and an ejection section 5.

The base material supply section 1 has a couple of rollers 11 and 11' and a transport device 12. The transport device 12 transports a paper base material P, on which a receptor layer is not formed, to the transfer section 3 through a path between the rollers 11 and 11'. The transport device 12 has, for example, rollers and a belt. Further, the development section 2 has guide rollers 101 and 101' as shown in FIG. 1.

The development section 2 is provide with: a coating storage section 21 for storing a white fine particles coating 200; a development sleeve 22 for holding the white fine particles coating 200 supplied from the coating storage section 21 on the surface thereof; a blade 23 for controlling the thickness of the white fine particles coating 200 held on the surface of the development sleeve 22; a charge drum 24 constructed by a photosensitive material, for absorbing the white fine particles coating 200 from the development sleeve 22; and a dot latent image forming device 25 for forming a dispersed dot latent image by irradiating a laser beam onto the surface of the charge drum 24.

The white fine particles coating 200 is composed of, for example, a mixture of a hydrophobic silica and a white fine particles composition. The white fine particles composition is produced by kneading a thermoplastic resin, a white pigment and a charge control agent and then grinding finely and classifying the mixture of them. Further, the white fine particles coating 200 is mixed with a carrier 210 made of, for example, an iron powder, and the white fine particles coating 200 is used in a condition of a developer. The white fine particles coating 200 is adhered on the surface of the carrier 210 by a static energy occurred by a frictional electrification between the white fine particles coating 200 and the carrier 210. In addition, the white fine particles coating 200 is supplied to the coating storage section 21 from the external in a condition of the developer as the occasion demand.

Figure 2:
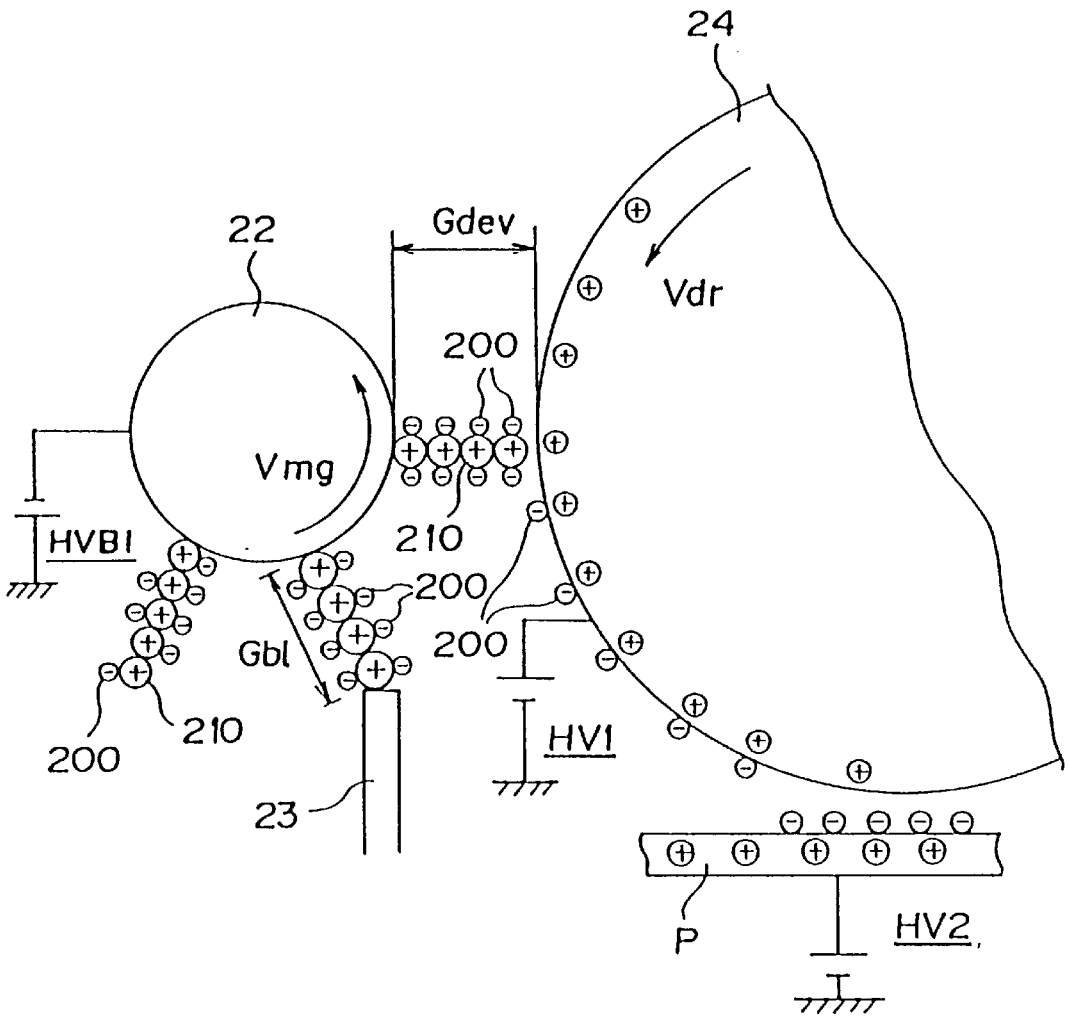
FIG. 2 is a diagram showing the movement of the white fine particles coatings according to an embodiment of the present invention.

In FIG. 2, the white fine particles coating 200 which is stored in the coating storage section 21 is adhered on the surface of the development sleeve 22 together with the carrier 210. Here, the development sleeve 22 consists of a magnet roller, and the voltage (i.e. the development bias voltage) HVBI is applied to the development sleeve 22. As the development sleeve 22 is rotated, the white fine particles coating 200 and the carrier 210 are uniformly distributed and held on the surface of the development sleeve 22 as the developer in which the white fine particles coating 200 and the carrier 210 are mixed in the constant weight ratio.

Figure 3:
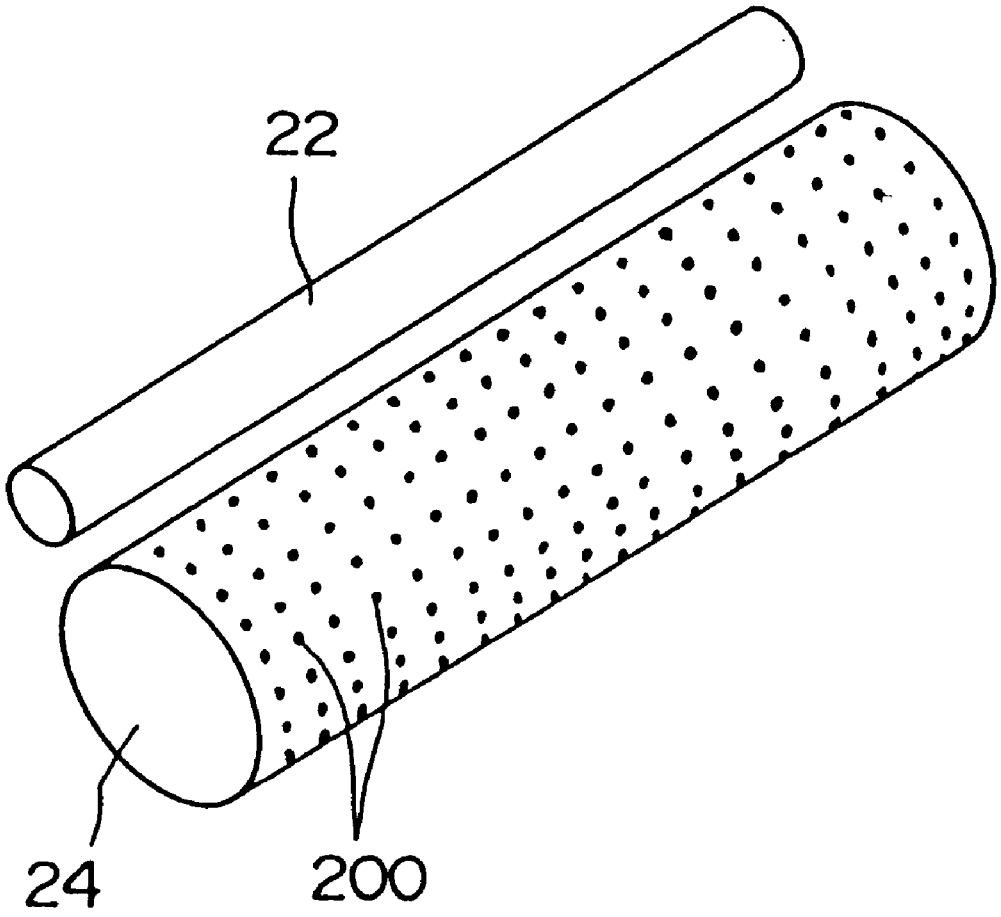
FIG. 3 is a diagram showing a development sleeve and a charge drum on which the white fine particles coating is adhered in the dispersed manner according to an embodiment of the present invention.

At this time, the charge drum 24 is electrified in the opposite polarity of the white fine particles coating 200 and is electrified in the dispersed manner as shown in FIG. 3. Namely, the charge drum 24 is constructed by a photosensitive material, and the surface of the charge drum 24 is electrified in the dispersed manner by the laser beam irradiated from the dot latent image forming device 25. Therefore, the white fine particles coating 200 held on the surface of the development sleeve 22 is moved to and absorbed on the surface of the charge drum 24. At this time, since the charge drum 24 is electrified in the dispersed manner, the white fine particles coating 200 is adhered on the surface of the charge drum 24 in the diffuse and sprinkled arrangement. In addition, the polarity of the white fine particles coating 200 is determined by the electrification controlling agent included in the white fine particles composition. The polarity of the charge drum 24 is determined by the kinds of the photosensitive material of the charge drum 24.

The dot latent image forming device 25 has, for example, a laser diode (LD) 30. The laser diode 30 emits the laser beam and scans the surface of the charge drum 24 by this laser beam. In this manner, the dot latent image forming device 25 draws the disposed dot latent image. The dispersed dot latent image is formed by arranging a plurality of dots of a latent image in the dispersed manner. The arrangement of dots of the dispersed dot latent image is in order, as shown in FIG. 3. However, the arrangement of them may be in random. Therefore, photoelectric charge is generated at the position that the dispersed dot latent image is formed on the surface of the charge drum 24.

The blade 23 controls the quantity (thickness) of the white fine particles coating 200 adhered on the surface of the charge drum 24 to be in a predetermined thickness. Namely, the thickness of the white fine particles coating 200 adhered on the surface of the development sleeve 22 is determined by the gap (blade gap) Gb1, i.e., the quantity of the white fine particles coating 200 that can be passed through the blade gap Gb1 is restricted in correspondence with the measure of the blade gap Gb1. As a result, the quantity of the white fine particles coating 200 adhered on the surface the charge drum 24 is restrict in this manner.

The blade gap Gb1 is 1.5 [mm] to 2.5 [mm], and preferably, 1.8 [mm] to 2.3 [mm]. If the blade gap Gb1 is smaller than 1.5 [mm], it may happen a case that the thermal transfer image receiving sheet S having the ability of forming the clear image thereon is not produced, since the quantity of the white fine particles coating 200 transferred to the paper base material P is not sufficient. On the other hand, If the blade gap Gb1 is larger than 2.5 [mm], the advantage corresponding to increase the quantity of the white fine particles coating 200 cannot be obtain, so that the white fine particles coating 200 is in vain, and it may happen that the thermal transfer image receiving sheet S is curled.

A gap (a development gap) Gdev between the development sleeve 22 and the charge drum 24 is 2.5 [mm] to 3.5 [mm], and preferably, 2.5 [mm] to 3.0 [mm]. If the development gap Gdev is smaller than 2.5 [mm], it is difficult to control the quantity of the white fine particles coating 200 moved to the charge drum 24, since the movement of the white fine particles coating 200 from the development sleeve 22 to the charge drum 24 is too easy. On the other hand, the development gap Gdev is larger then 3.5 [mm], it may happen a case that the thermal transfer image receiving sheet S having the ability of forming the clear image thereon is not produced, since the movement of the white fine particles coating 200 from the development sleeve 22 to the charge drum 24 becomes hard.

Then, the white fine particles coating 200 adhered on the surface of the charge drum 24 in the dispersed manner is moved toward the transfer section 3 with a rotation of the charge drum 24.

In the transfer section 3, the electric charge, of which polarity is opposite to that of the white fine particles coating 200, is applied to the paper base material P toward the back side thereof (i.e. the surface at the side opposite to the surface to which the white fine particles coating 200 is transferred), and the white fine particles coating 200 is electrostatically transferred onto the paper base material P in the dispersed manner by the electrostatic force.

In the development section 2, after the white fine particles coating 200 is transferred to the paper base material P, a cleaner 26 removes the residual of the white fine particles coating 200 adhered on the surface of the charge drum 24, and a discharge device 27 discharges the electric charge of the charge drum 24. Here, the cleaner 26 consists of, for example, a blade. The discharge device 27 consists of, for example, an LED (Light Emitting Diode) optical discharge device. After the charge drum 24 is discharged, the dot latent image forming device 25 emits the laser beam, and forms the dispersed dot latent image on the surface of the charge drum 24. Therefore, the photoelectric charge is generated at the position that the dispersed dot latent image is formed on the surface of the charge drum 24, and the charge drum 24 is electrified again.

The paper base material P, on which the white fine particles coating 200 is electrostatically transferred in the dispersed manner in the development section 3, is transported to the fixing section 4 by a transport device 15. The transport device 15 consists of, for example, rollers and a belt.

The fixing section 4 consists of a heat roller 41 and a press roller 42. The paper base material P transported by the transport device 15 goes through a path between the heat roller 41 and the press roller 42, so that the white fine particles coating 200 on the paper base material P is heated and pressed. Consequently, the white fine particles coating 200 is melted and is thus fixed on the paper base material P, so that a receptor layer coating membrane is formed on the paper base material P.

The surface of the heat roller 41 is made of, for example, a silicone elastomer, a silicone resin, or a fluorocarbon resin. The surface of the press roller 42 is made of, for example, a silicone elastomer, and the hardness of the press roller 42 is normally about 20 degrees to 80 degrees.

In this manner, the thermal transfer image receiving sheet S, which consists of the paper base material, on which the receptor layer coating membrane is formed, is produced, and the thermal transfer image receiving sheet S is ejected from the ejection section 5.

The ejection section 5 has a separation claw 51. The thermal transfer image receiving sheet S is tightly adhered on the surface of the heat roller 41 by the heat and pressure applied in the fixing section 3. The separation claw 51 separates the thermal transfer image receiving sheet S from the surface of the heat roller 41.

In the apparatus 100 of this embodiment, the ejection section 5 may be deposited such that the direction of the ejection of the thermal transfer image receiving sheet S is along the heat roller 41, as shown in FIG. 1. Therefore, the thermal transfer image receiving sheet S having an ability that a high quality image can be formed thereon, is produced, as compared with the case that the ejection section 5 is deposited such that the direction of the ejection of the thermal transfer image receiving sheet S is along the press roller 42, or the case that the ejection section 5 is deposited such that the direction of the ejection of the thermal transfer image receiving sheet S is horizontal.

Next, the method of producing the thermal transfer image receiving sheet of the present invention, and the thermal transfer image receiving sheet produced thereby will be explained.

In the method of the present invention, the thermal transfer image receiving sheet is produced by using the above mentioned apparatus 100 in a following condition.

At first, the paper base material P, on which the receptor layer is not formed, for example, a plain paper, is loaded into the base material supply section 1 of the apparatus 100 in FIG. 1. On the other hand, for example, the aforementioned white fine particles coating 200 is supplied to the coating storage section 21.

Thereafter, the apparatus 100 is operated in the following condition.

Namely, a development bias voltage HVBI, which is the voltage applied to the development sleeve 22, is set as:

$$30[V] \leqq |HVBI|,$$

and preferably:

$$100\ [V] \leqq |HVBI|.$$

If the development bias voltage HVBI is out of the range of: 30[V]≦|HVBI|, the quantity of the white fine particles coating 200 supplied to the development sleeve 22 becomes out of the suitable range, so that the thermal transfer image receiving sheet S on which a high quality image can be formed, may not be produced.

A peripheral velocity of the development sleeve 22 (a sleeve peripheral velocity) Vmag is set as:

$$10[\mathrm{mm/sec}] \leqq Vmag \leqq 300[\mathrm{mm/sec}],$$

and preferably:

$$30[\mathrm{mm/sec}] \leqq Vmag \leqq 60[\mathrm{mm/sec}].$$

If the sleeve peripheral velocity Vmag is lower than 10 [mm/sec], it may happen that the quantity of the white fine particles coating 200 supplied to the development sleeve 22 is excess, so that the white fine particles coating 200 is in vain, and the thermal transfer image receiving sheet S may be curled. In contrast, if the sleeve peripheral velocity Vmag is higher than 300 [mm/sec], it may happen that the quantity of the white fine particles coating 200 supplied the development sleeve 22 is not sufficient, so that the thermal transfer image receiving sheet S having the ability of forming the clear image thereon may not be produced.

A charge voltage HV1, which is a voltage applied to the charge drum 24, is set as:

$$|HV1| \leqq 6.0[\mathrm{kV}],$$

and preferably:

$$4.0[\mathrm{kV}] \leqq |HV1| \leqq 6.0[\mathrm{kV}].$$

If the charger voltage HV1 is out of the range of: |HV1|≦6.0 [kV], the quantity of the white fine particles coating 200 adhered on the surface of the charger drum 24 becomes out of the suitable range, so that the thermal transfer image receiving sheet S having an ability that a high quality image can be formed thereon may not be produced.

As mentioned above, the dot latent image forming device 25 draws the dispersed dot latent image on the charge drum 24, and the dispersed dot latent image is formed by arranging a plurality of dots of the latent image in the dispersed manner, as shown in FIG. 3.

Here, the diameter of each dot of the dispersed dot latent image is not more than half of the diameter of each dot formed at the time of printing, and preferably not more than a quarter of the diameter of each dot formed at the time of printing. If the diameter of the each dot of the dispersed dot latent image is more than half of each dot formed at the time of printing, the diameter of each dot of the coat forming the receptor layer coating membrane is too large. As a result, dye may be bled on the thermal transfer image receiving sheet S, and an image formed on the thermal transfer image receiving sheet S becomes indefinite.

In order to form each dot of the dispersed dot latent image whose diameter is in the aforementioned range, the diameter of the spot of the laser beam irradiated to the charge drum 24 form the laser diode 30 of the dot latent image forming device 25 and the movement of this laser beam are respectively controlled.

A drum peripheral velocity Vdr, which is a peripheral velocity of the charger drum 24, is set as:

$$10[\text{mm/sec}] \leqq Vdr \leqq 100[\text{mm/sec}],$$

and preferably:

$$20[\text{mm/sec}] \leqq Vdr \leqq 60[\text{mm/sec}].$$

If the drum peripheral velocity Vdr is lower than 10 [mm/sec], it may happen that the quantity of the white fine particles coating 200 adhered on the charger drum 24 is excess. In contrast, if the drum peripheral velocity Vdr is higher than 100 [mm/sec], it may happen that the quantity of the white fine particles coating 200 adhered on the charge drum 24 is not sufficient.

In the transfer section 3, a transfer voltage HV2, which is the voltage applied to the paper base material P, is set as:

$$|HV2| \leqq 7.0[\text{kV}],$$

and preferably:

$$5.0[\text{kV}] \leqq |HV2| \leqq 6.0[\text{kV}].$$

If the transfer voltage HV2 is out of the range of: $|HV2| \leqq 7.0$ [kV], it may happen that the quantity of the white fine particles coating 200 transferred onto the paper base material P becomes out of the suitable range, so that the thermal transfer image receiving sheet S having an ability that a high quality image can be formed thereon may not be produced.

In the fixing section 4, the fixing temperature The of the heat roller 41 is set as:

$$100[^\circ\text{ C.}] \leqq \text{The} \leqq 200[^\circ\text{ C.}],$$

and preferably:

$$100[^\circ\text{ C.}] \leqq \text{The} \leqq 150[^\circ\text{ C.}]$$

If the fixing temperature The is lower than 100[° C.], it may happen that the fixation of the white fine particles coating 200 onto the paper base material P is not sufficient. In contrast, if the fixing temperature The is higher than 200 [° C.], the white fine particles coating 200 on the paper base material P is partially transferred to the heat roller 41. As a result, the receptor layer coating membrane may not be uniformly formed on the paper base material P.

Further, in the fixing section 4, the fixing pressure Phe by the press roller 42 is set as:

$$0.2[\text{kgf/cm}] \leqq Phe \leqq 2.0[\text{kgf/cm}],$$

and preferably:

$$0.4[\text{kgf/cm}] \leqq Phe \leqq 1.0[\text{kgf/cm}].$$

If the fixing pressure Phe is lower than 0.2 [kgf/cm], it may happen that the fixation of the white fine particles coating 200 onto the paper base material P is not sufficient. In contrast, if the fixing pressure Pth is higher than 2.0 [kgf/cm], it may happen that the thickness of the receptor layer coating membrane formed on the paper base material P is not sufficient.

In addition, in the method of the present invention, a mold releasing oil may be coated on the surface of the heat roller 41. In this case, for example, a straight silicon oil is used as the mould releasing oil, and the mould releasing oil can be coated on the surface of the heat roller 41 by the method as following. Namely, at first, the mold releasing oil is impregnated in a felt pat. Then, the mold releasing oil is spread on the surface of the heat roller 41 by the felt pat impregnated with the mold releasing oil.

In the method of the present invention, the thermal transfer image receiving sheet S, which the receptor layer coating membrane is formed on the paper base material P in the above explained manner, may be pulled out from the side of the heat roller 41. Therefore, the thermal transfer image receiving sheet S having the ability that a more excellent quality image can be formed thereon is produced, as compare with the case that the thermal transfer image receiving sheet S, on which the receptor layer coating membrane is formed, is pulled out from any other sides.

The thermal transfer image receiving sheet S obtained the above mentioned method has the dispersed and discontinuous receptor layer coating membrane. Especially, since the receptor layer coating membrane is shaped like diffused and sprinkled dots as shown in FIG. 3, and the diameter of each dot of the receptor layer coating membrane is not more than half of the diameter of each dot formed at the time of printing and preferably not more than a quarter of the diameter of each dot formed at the time of printing, the discontinuous receptor layer coating membrane can be formed. If the diameter of each dot of the receptor layer coating membrane is more than half of diameter of each dot of print, the receptor layer coating membrane cannot be sufficiently made discontinuous, so that the occurrence of bleeding cannot be sufficiently prevented.

Further, the thickness of the receptor layer coating membrane is in the range of 1 to 50 [μm], preferably is in the range of 1 to 20 [μm]. If this thickness is less than 1 [μm], the basic function and effect of the receptor layer coating membrane is not obtained, i.e., the shape of image formed by the sublimation dye cannot be kept. On the other hand, if this thickness is more than 50 [μm], the profitable effect cannot be obtained.

As mentioned above, since the thermal transfer image receiving sheet of the present invention has the discontinuous receptor layer coating membrane, the boundary between the high dyeing property region and the low dyeing property region is clear. Therefore, in the sublimation type thermal transfer recording, it can be reduced that dye is bled at the edge of the image formed on the thermal transfer image receiving sheet S, so that the definite image can be formed on the thermal transfer image receiving sheet S. Further, the thermal transfer image receiving sheet of the present invention has the dispersed and discontinuous receptor layer coating membrane, and thus, the paper base material P is partially exposed. Therefore, the thermal transfer recording using a melting type ink film can be realized.

EXAMPLE

The thermal transfer image receiving sheet is produced by the method of above explained embodiment, using a PPC paper (the diameter of each dot of the receptor layer coating membrane is 20 [μm]), which size is A4. The quantity of the white fine particles coating electrostatically transferred onto the PPC paper is set as 21 [g/m$^2$]. Then, the high velocity recording test of thermal transfer recording of sublimation type by using a thermal head, is carried out concerning the thermal transfer image receiving sheet produced in the above mentioned condition. Namely, a gradation pattern image, which consists of color images of Y (Yellow), I (magenta), C (Cyan), and K (black), is thermally transferred onto the PPC paper, and the transfer sensitivity and the existence of bleeding are evaluated. The result of this evaluation is set forth in Table below.

In addition, the transfer sensitivity is evaluated on the basis of the optical density (O.D. value), and the bleeding is evaluated by the visual observation about the edge of the printed image using a loupe.

The condition of the high velocity recording test is following.

Ink Ribbon: thermal transfer ink ribbon of 4 color (Y, M, C, K) sublimation type Thermal Head: KGT-219-12MPL27 (made by Kyosera Kabusikigaisya)

Driving Voltage: 18 to 19 [V]

Line Velocity: 3.8 [msec/line]

Further, the white fine particles coating, which is composed as following, is used.

Saturated Polyester Resin: 73 percentage by weight

Styrene Acrylic Copolymerization Resin: 15 percentage by weight

Offset Inhibitor: 4 percentage by weight

Charge Control Agent (positive electric charge): 2 percentage by weight

White Pigment: 5 percentage by weight

Amino Denaturation Silicone Oil: 0.5 percentage by weight

Epoxy Denaturation Silicone Oil: 0.5 percentage be weight

To form a receptor layer coating membrane onto the PCC paper, the following agent is used. Namely, the aforementioned ingredients are melted, mixed, and then the mixture of them is ground finely and classified. Thus, the white fine particles composition is obtained. Further, this white fine particles composition (100 weight parts) is mixed with the hydrophobic silica (0.5 weight parts) to adjust them. Then, the carrier (e.g. the iron powder) is mixed with the white fine particles composition such that the concentration of the white fine particles composition is 8.4 percentage by weight. The white fine particles coating produced in this manner, is used as the developer.

COMPARATIVE EXAMPLE

As a comparative example, another thermal transfer image receiving sheet is prepared. This thermal transfer image receiving sheet is the same construction as that in the aforementioned EXAMPLE except for the construction of the receptor layer. Namely, the receptor layer of this thermal transfer image receiving sheet is constructed by two regions of micro phase separation resins, whose dyeing properties are different from each other. By using this thermal transfer image receiving sheet, the evaluation is done in the same condition as that in the aforementioned EXAMPLE. Thus, the result of this evaluation is set forth in Table below.

| | | EXAMPLE | COMPARATIVE EXAMPLE |
|---|---|---|---|
| Transfer | Y | 1.80 | 1.60 |
| Sensitivity | M | 1.85 | 1.65 |
| (O.D. value) | C | 1.95 | 1.75 |
| | K | 1.45 | 1.20 |
| Bleeding | Y | No bleeding | Bleeding is occurred. |
| at the edge | M | No bleeding | Bleeding is occurred. |
| of the printed | C | No bleeding | Bleeding is occurred. |
| image | K | No bleeding | Bleeding is occurred. |

As understood from Table, in the example according to the present embodiment, bleeding is not occurred in every colors. In contrast, in the aforementioned comparative example, bleeding is occurred in every colors. As a result, the example according to the present embodiment is superior to the aforementioned comparative example in the quality of print.

According to the apparatus 100 for coating fine particles to produce the thermal transfer image receiving sheet S described above, only if the paper base material P on which a receptor layer is not formed, for example, plain paper (normal paper), is supplied, the thermal transfer image receiving sheet S, which has the dispersed and discontinuous receptor layer coating membrane formed on the plain paper by the fixation of the white fine particles coating 200, and which has the ability that a high quality and clear image can be formed thereon, can be easily obtained.

Further, according to the method of coating fine particles to produce a thermal transfer image receiving sheet described above, the thermal transfer image receiving sheet S, on which has a high quality and clear image can be formed, can be easily produced by using the paper base material P on which a receptor layer is not formed, for example, a plain paper, as occasion demand. Therefore, the number of the thermal transfer image receiving sheets S can be freely and conveniently controlled in correspondence with necessity.

Furthermore, since the thermal transfer image receiving sheet S of the embodiment has the dispersed and discontinuous receptor layer coating membrane, the occurrence of the bleeding can be reduced, and thus, the clear image can be formed thereon.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A thermal transfer image receiving sheet comprising:

a base paper material; and a receptor layer coating membrane formed on the base paper material, the receptor layer membrane including a plurality of white particles formed on the base paper material in accordance with a predetermined dot latent image, such that the predetermined dot latent image is formed by arranging a plurality of dots in a dispersed and discontinuous manner.

2. The thermal transfer image receiving sheet according to claim 1, wherein the receptor layer coating membrane is formed by arranging a pluralilty of dots of the white particles in accordance with the predetermined dot latent image, and a diameter of each of the plurality of dots of the white particles is not more than half of a diameter of each of a plurality of print dots formed at the time of printing.

3. The thermal transfer image receiving sheet according to claim 1, wherein the receptor layer coating membrane is formed by placing the white fine particles on the predetermined dot latent image formed on a charge drum, and then transferring the white fine particles from the charge drum onto the base paper material.

* * * * *